US012601563B2

(12) United States Patent
Masek et al.

(10) Patent No.: US 12,601,563 B2
(45) Date of Patent: Apr. 14, 2026

(54) RIFLE CASE SYSTEM

(71) Applicants: Zachary Masek, Jackson, WY (US); Sam Ristich, Los Angeles, CA (US)

(72) Inventors: Zachary Masek, Jackson, WY (US); Sam Ristich, Los Angeles, CA (US)

(73) Assignee: FORUM LLC, Mountain Brook, AL (US)

( * ) Notice: Subject to any disclaimer, the term of this patent is extended or adjusted under 35 U.S.C. 154(b) by 0 days.

(21) Appl. No.: 18/818,819

(22) Filed: Aug. 29, 2024

(65) Prior Publication Data

US 2026/0063387 A1 Mar. 5, 2026

(51) Int. Cl.

| | |
|---|---|
| ***F41C 33/06*** | (2006.01) |
| ***A45C 5/14*** | (2006.01) |
| ***A45C 7/00*** | (2006.01) |
| ***A45C 13/02*** | (2006.01) |
| *A45C 13/26* | (2006.01) |

(52) U.S. Cl.

CPC ..... *F41C 33/06* (2013.01); *A45C 5/14* (2013.01); *A45C 7/0045* (2013.01); *A45C 7/005* (2013.01); *A45C 13/02* (2013.01); *A45C 2013/026* (2013.01); *A45C 2013/267* (2013.01)

(58) Field of Classification Search

CPC ..... A45C 5/14; A45C 7/00; A45C 7/0045; A45C 7/005; A45C 13/02; A45C 2013/026; A45C 2013/267; F41C 33/06; F10G 7/005; G10G 7/005

USPC ..... 206/317

See application file for complete search history.

(56) References Cited

U.S. PATENT DOCUMENTS

| | | | | |
|---|---|---|---|---|
| 4,721,205 | A * | 1/1988 | Burt | F41C 33/06 206/317 |
| 6,570,501 | B2 * | 5/2003 | Bushnell | F41C 33/06 206/317 |
| 7,116,224 | B2 * | 10/2006 | Mickler | F41C 33/06 206/317 |
| 8,523,201 | B2 * | 9/2013 | Allen | G10G 7/005 206/314 |
| 9,016,701 | B2 * | 4/2015 | Allen | G10G 7/005 280/47.34 |

* cited by examiner

*Primary Examiner* — Bryon P Gehman

(74) *Attorney, Agent, or Firm* — Ewing & Jones, PLLC

(57) ABSTRACT

A rifle carrying case system. The rifle carrying case system includes a utility case for carrying rifles, a roller case for carrying rifle gear and accessories, and a docking station for mounting the utility case to a support structure such as a wall. The utility case and the roller bag case each include corresponding attachment mechanisms that enables the utility case to be removably coupled to the roller case for easy transit of the cases as a combined single unit. The attachment mechanisms include upper and lower hook members configured with the roller bag (e.g., with its extendable handle) and corresponding slots on the utility case that may be engaged by the hooks.

15 Claims, 14 Drawing Sheets

RIFLE CASE SYSTEM

FIELD OF THE INVENTION

The present invention relates to cases, including a case system for rifles.

BACKGROUND

Carrying cases customized to carry and transport particular items are known throughout the world. For example, some carrying cases have been customized to carry rifles and rifle gear. Such rifle cases may be used by gun enthusiasts to carry firearms as well as ammunition and other accessories to and from shooting ranges, on hunting trips, and so forth.

However, rifle carrying cases are typically somewhat bulky given the large size of the rifles and the amount of necessary gear (e.g., ammunition) that may need to be carried. In addition, multiple cases are typically needed to carry all of the equipment that a gun enthusiast may require. However, managing multiple individual cases all at once during transit of the cases may prove difficult.

Accordingly, there is a need for a rifle carrying case system that consolidates a number of cases together for transit.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

In general, and according to exemplary embodiments hereof, a carrying case system is provided. The carrying case system includes two or more separate and individual cases that may be combined for transit, as well as a wall mount for storing the cases.

For the purposes of this specification, the carrying case system 10 will be described primarily as a rifle case system for carrying and storing rifles and rifle accessories. However, it is understood that the carrying case system 10 may be used to carry and store any type(s) of items that may benefit from the carrying case system 10 and that the scope of the carrying case system 10 is not limited in any way by the type(s) of items that it may be used with to carry and store.

Figure 1:
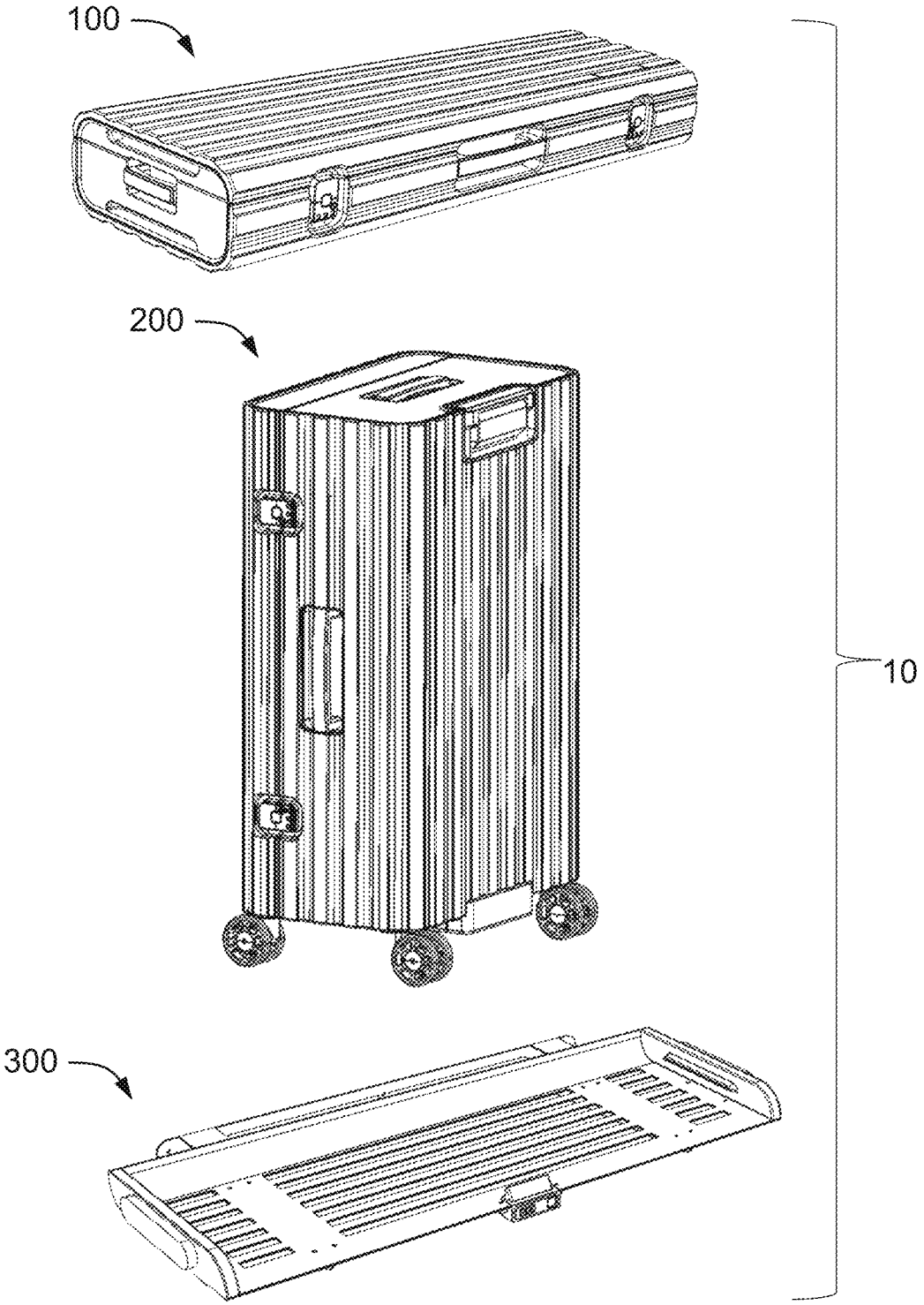
FIG. 1 shows a carrying case system according to exemplary embodiments hereof.

FIG. 1 shows the carrying case system 10 including a utility case assembly 100, a roller case assembly 200, and a docking assembly 300. In general, the utility case assembly 100 (also referred to herein as a rifle case) may include a case for holding items such as, but not limited to, rifles, and the roller case assembly 200 (also referred to herein as a range case) may include a roller case for holding items such as, but not limited to, firearm accessories. The utility case assembly 100 and the roller case assembly 200 may each include corresponding attachment mechanisms so that the two case assemblies 100, 200 may be coupled together for transit. In this way, a user may utilize the roller case's 200's functionalities (e.g., its telescoping handle and the roller wheels) to easily transport both cases 100, 200 together and in combination. The docking assembly 300 may include wall mounted shelf assembly for storing elements of the carrying case system 10 (also referred to herein as simply the system 10), such as the utility case assembly 100 and/or the roller case assembly 200. The system 10 also may include other elements and components as necessary to fulfill its functionalities.

Utility Case Assembly 100

Figure 2:
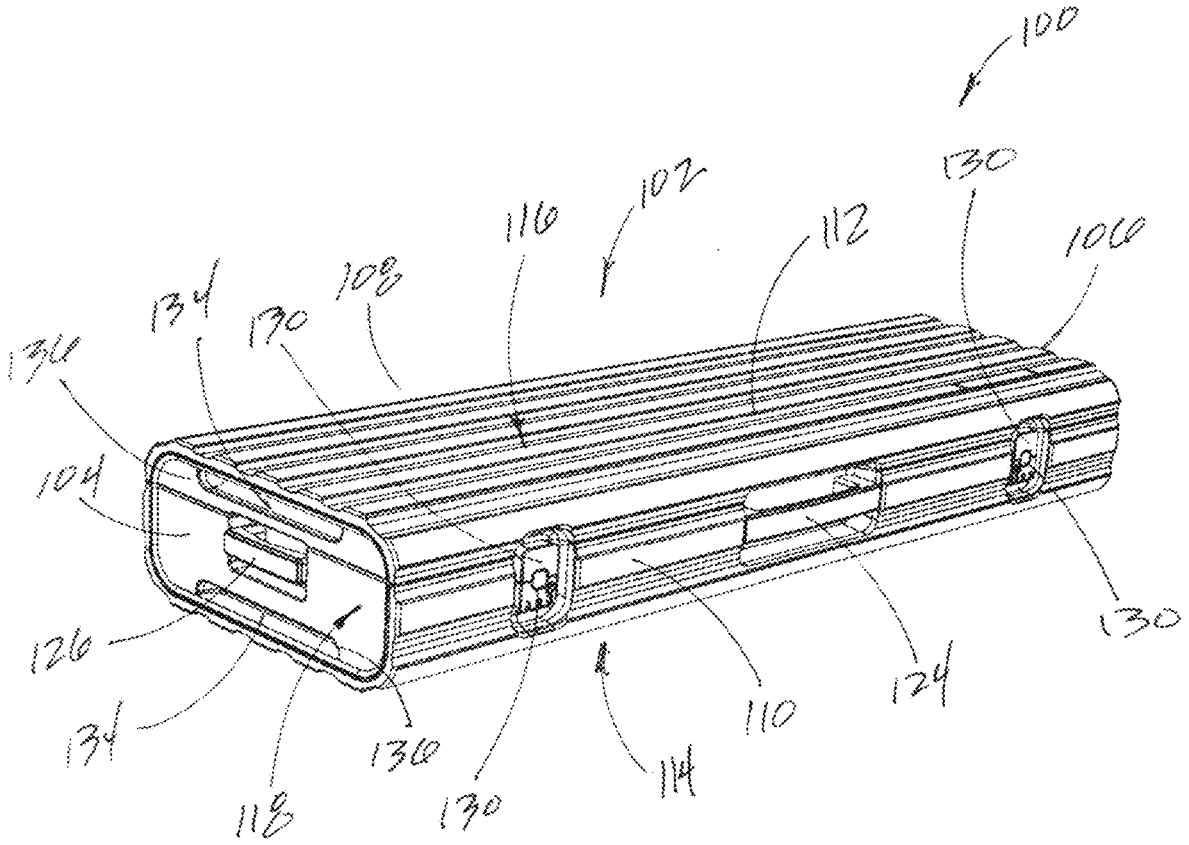
FIGS. 2 and 3 show aspects of a utility case according to exemplary embodiments hereof.
Figure 3:
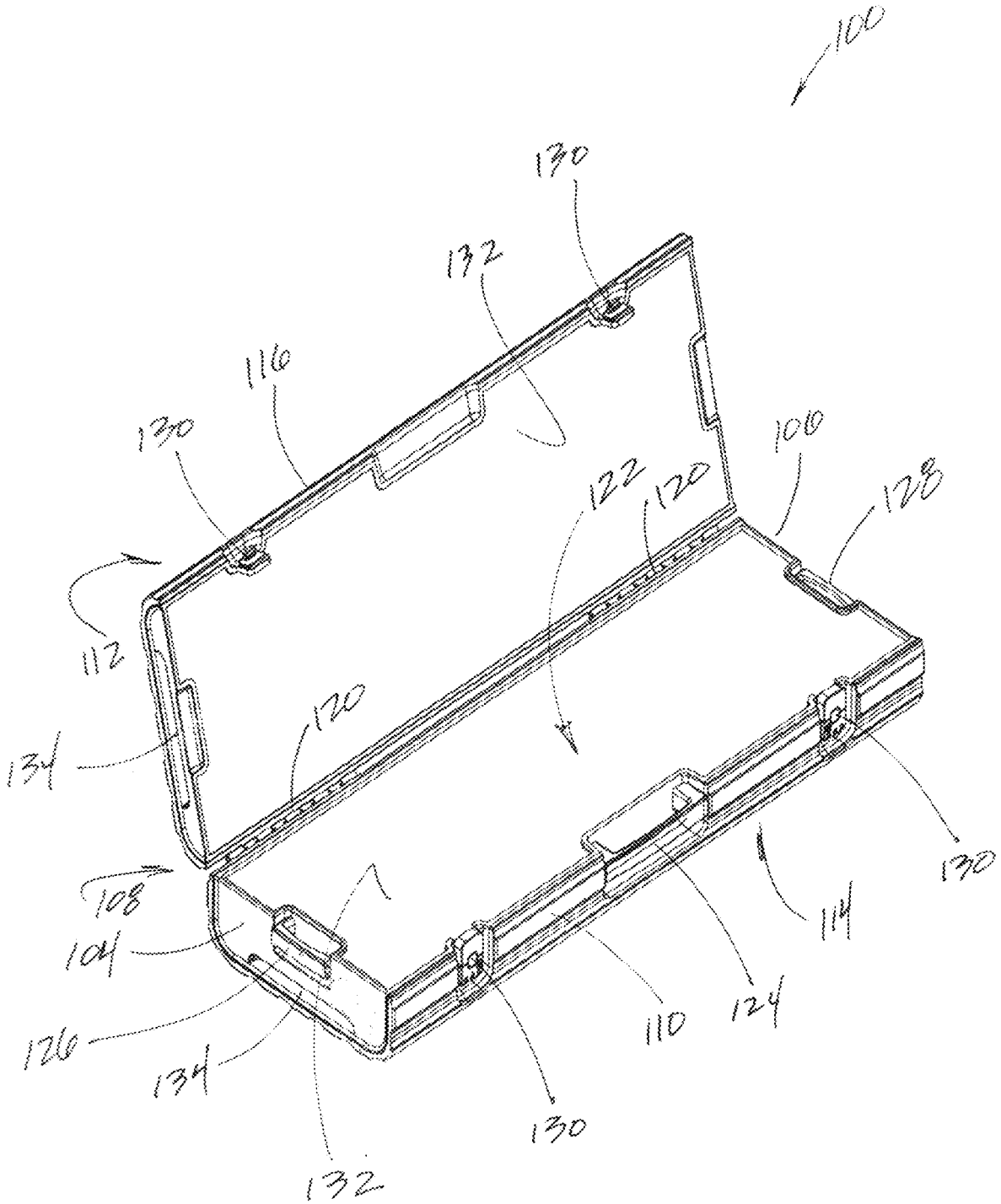

FIG. 2 shows a perspective view of the utility case assembly 100 closed and FIG. 3 shows a perspective of the utility case assembly 100 opened.

In some embodiments, as shown in FIGS. 2 and 3, the utility case assembly 100 includes a case 102 generally including a left side 104, a right side 106, a rear side 108, a front side 110, a top side 112, and a bottom side 114. The top side 112 may comprise a lid 116 removably coupled to the case's body portion 118. In some embodiments, as shown in FIG. 3, the lid 116 is coupled to the body portion 118 using one or more hinges 120, e.g., on the rear side 108 of the case 102. As shown in FIG. 3, the case 102 includes an inner volume 122 accessible when the lid 116 is opened. When opened, it may be preferable that the lid 116 extend open about 105° from the horizontal plane so that the lid 116 remains open until intentionally closed. In some embodiments, the inner volume 122, e.g., the interior surface of the lid 116 and/or the interior surface of the body portion 118, may include liner materials 132 such as anti-slip dual multilayered foam padding and/or other suitable materials to secure items (e.g., rifles) placed into the case's inner volume 122.

In some embodiments, the case 102 includes a front handle 124 on its front side 110 (e.g., preferably centered between the left and right sides 104, 106), a left handle 126 on its left side 104, and a right handle 128 on its right side 106 (see FIG. 3).

In some embodiments, the case 102 includes one or more locking mechanisms 130 on its front side 110 implemented between the lid 116 and the body portion 118 to lock the lid 116 in a locked position with the body 118 and to unlock the lid 116 from the body 118 so that the lid 116 may be opened. In some embodiments, the locking mechanisms 130 may include latches or other types of locking mechanisms. For example, in some embodiments, the locking mechanisms 130 may include a combination lock with roman numerals and/or other types of locks with other types of combination protocols.

In some embodiments, the case 102 includes one or more first attachment mechanisms 134 that may be used to attach and secure the case 102 to the roller case assembly 200 for transit and storage. In some embodiments, the first attachment mechanisms 134 may interface with corresponding second attachment mechanisms on the roller case assembly 200 as described in other sections. Further details of the first and second attachment mechanisms will be described below.

In some embodiments, the shell of the utility case 102 comprises rubber coated plastic and/or other suitable materials.

Roller Case Assembly 200

Figure 4:
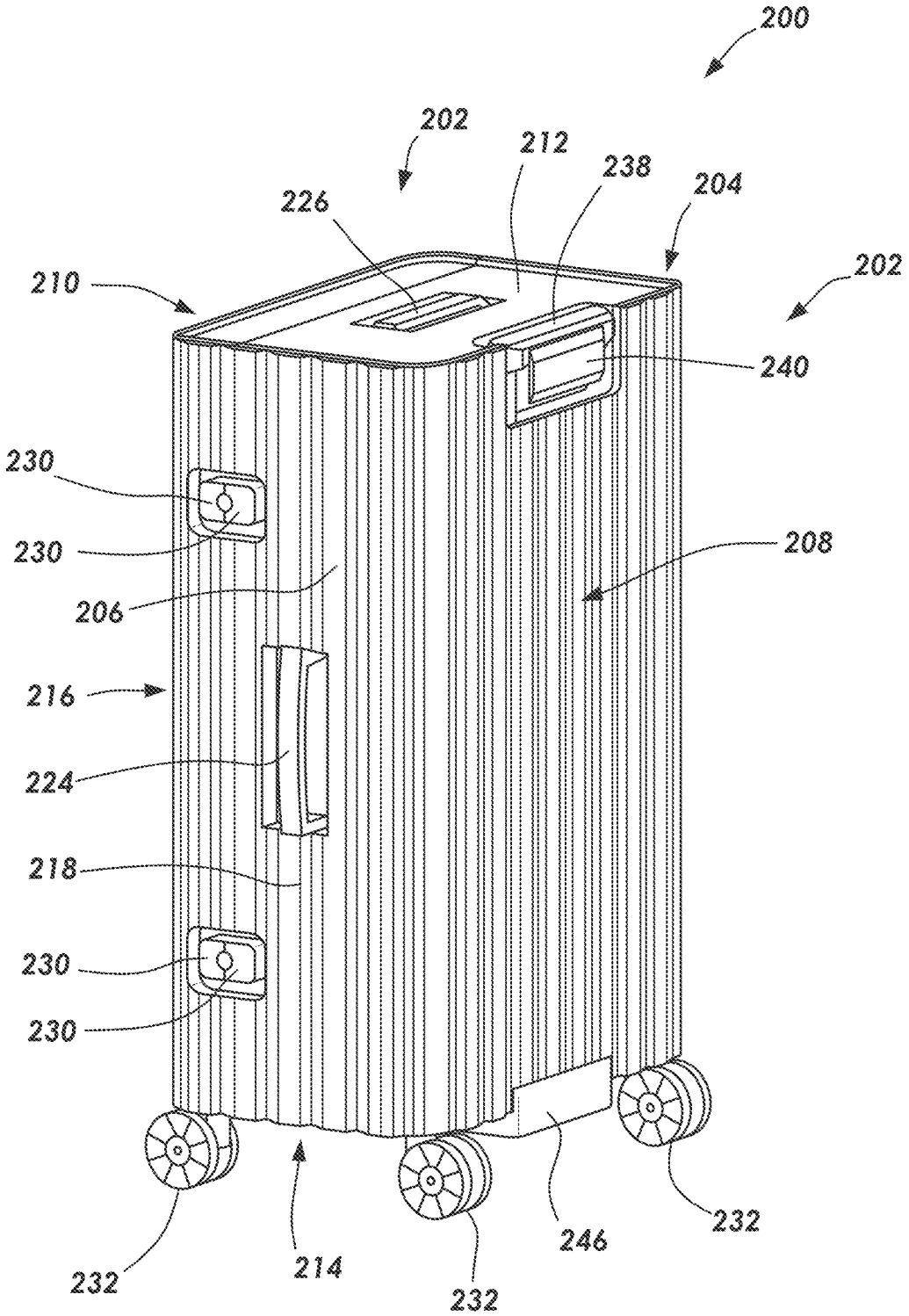
FIGS. 4-8 show aspects of a roller case according to exemplary embodiments hereof.
Figure 5:
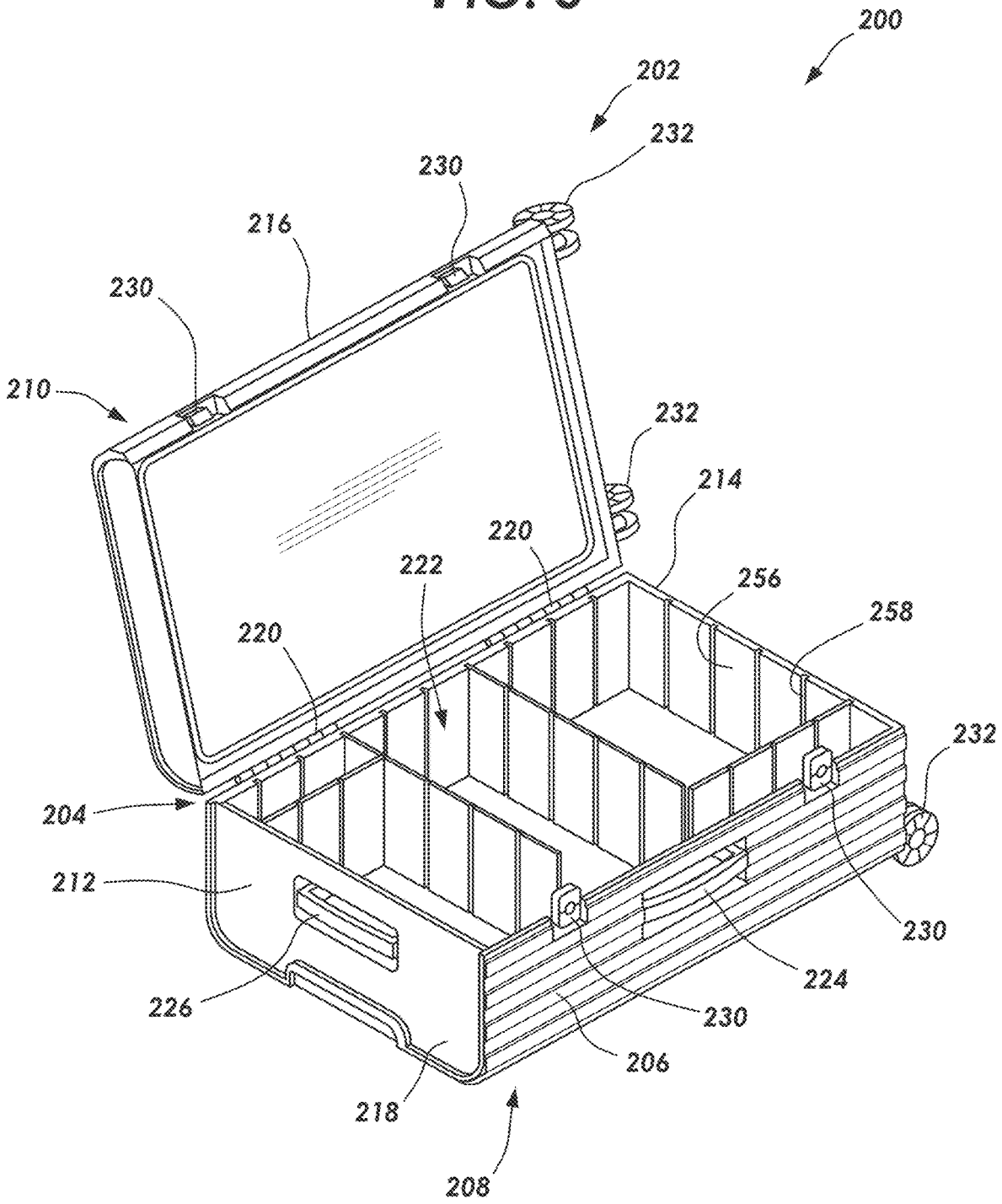

FIG. 4 shows a perspective view of the roller case assembly 200 closed and FIG. 5 shows a perspective of the roller case assembly 200 opened.

In some embodiments, as shown in FIGS. 4 and 5, the roller case assembly 200 includes a roller case 202 generally including a left side 204, a right side 206, a rear side 208, a front side 210, a top side 212, and a bottom side 214. The front side 210 may comprise a lid 216 removably coupled to the case's body portion 218. In some embodiments, as shown in FIG. 5, the lid 216 is coupled to the body portion 218 using one or more hinges 220, e.g., on the left side 204 of the case 202. As shown in FIG. 5, the case 202 includes an inner volume 222 accessible when the lid 216 is opened. When opened, it may be preferable that the lid 216 extend open about 105° from the horizontal plane so that the lid 216 remains open until intentionally closed. In some embodiments, the inner volume 222, e.g., the interior surface of the lid 216 and/or the interior surface of the body portion 218, may include liner materials, e.g., the interior surface of the lid 216 may include a woven elastic object retention system 232, and the interior surface of the body 218 may include anti-slip multilayered foam padding and/or other suitable materials to secure items (e.g., rifle gear) placed into the case's inner volume 222. The roller case system 200 also may include a flexible divider system as described in other sections.

In some embodiments, the case 202 includes a side handle 224 on its right side 206 (e.g., preferably centered between the top and bottom sides 212, 214) and a top handle 226 on its top side 212.

In some embodiments, the case 202 includes one or more locking mechanisms 230 on its right side 206 implemented between the lid 216 and the body portion 218 to lock the lid 216 in a locked position with the body 218 and to unlock the lid 216 from the body 218 so that the lid 216 may be opened. In some embodiments, the locking mechanisms 230 may include latches or other types of locking mechanisms. For example, in some embodiments, the locking mechanisms 130 may include a combination lock with roman numerals and/or other types of locks with other types of combination protocols.

In some embodiments, the roller case assembly 200 includes one or more wheel members 232 (e.g., caster wheels and/or other suitable wheels) to facilitate rolling movement of the case 202.

In some embodiments, the roller case assembly 200 includes an extendable handle system 234 configured on its rear side 208 (and/or on any suitable side of the case 202). FIG. 4 shows the extendable handle system 234 in its retracted position and FIG. 5 shows the extendable handle system 234 in its extended position. The extendable handle system 234 may be telescopic and/or may be extendable using other means.

Figure 6:
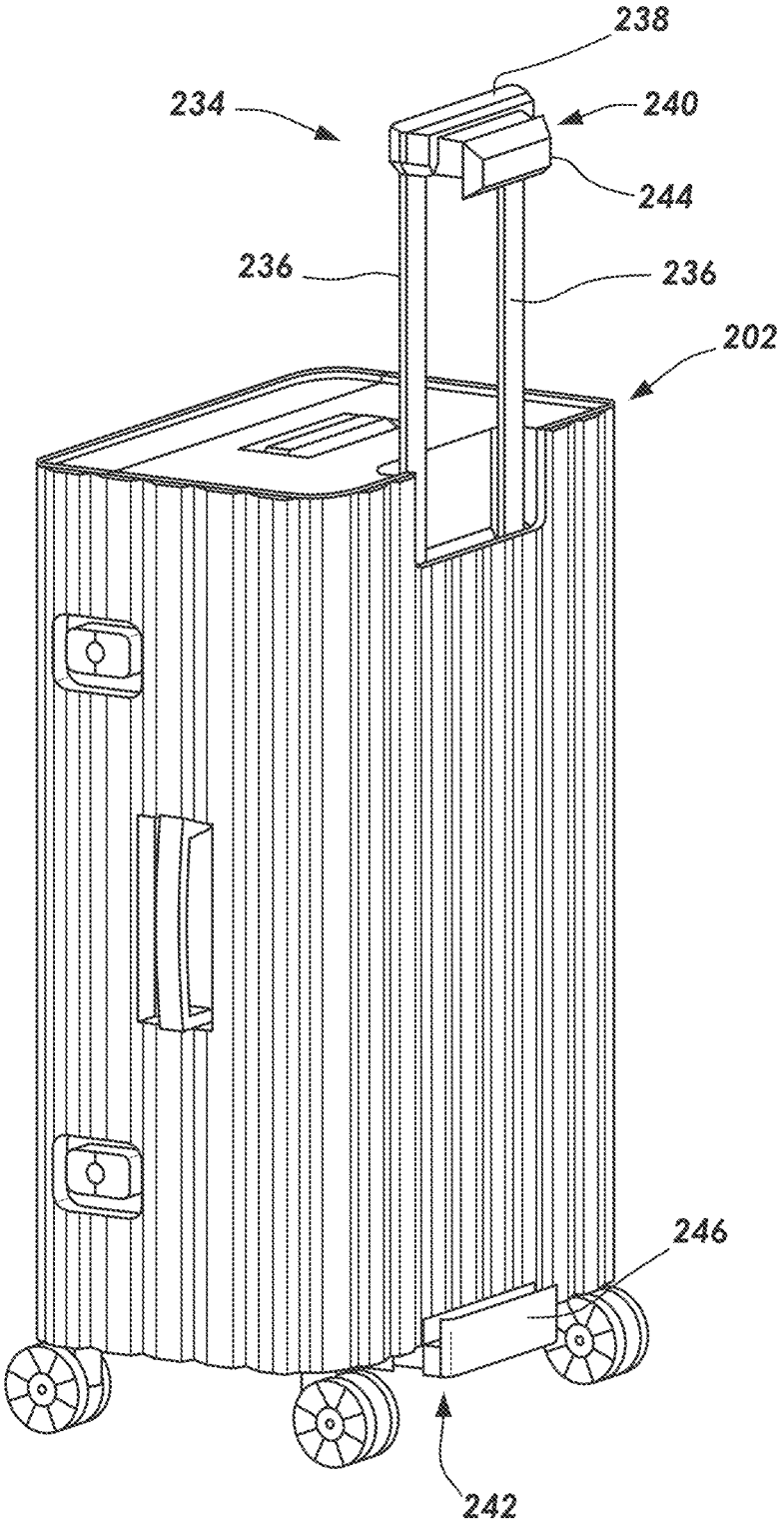

In some embodiments, as shown in FIG. 6, the extendable handle system 234 includes an extendable support portion 236, e.g., two side-by-side rods or other suitable elongate members that may extend from and/or retract into receiving channels within the case 202 (e.g., within the case's body portion 218). The extendable handle system 234 also may include an upper handle 238 coupled to a distal end of the extendable support portion 236 that the user may grasp to physically manipulate the roller case assembly 200 (e.g., to hold while rolling the case 202 as is known in the art). In use, a user may grip the handle 238 and pull upward to extend the extendable handle system 234 from the cases' body 218 and may subsequently push down on the handle 238 to retract the extendable handle system 234 into the case's body portion 218. In some embodiments, the extendable handle 234 may be biased (e.g., spring-loaded) upward and/or downward and releasably lockable in either the fully extended and/or fully retracted position.

In some embodiments, the extendable support portion 236 may be extended upward a distance of about 1" to about 24", and preferably about 6" to about 18", and more preferably about 8" to about 12".

Figure 7:
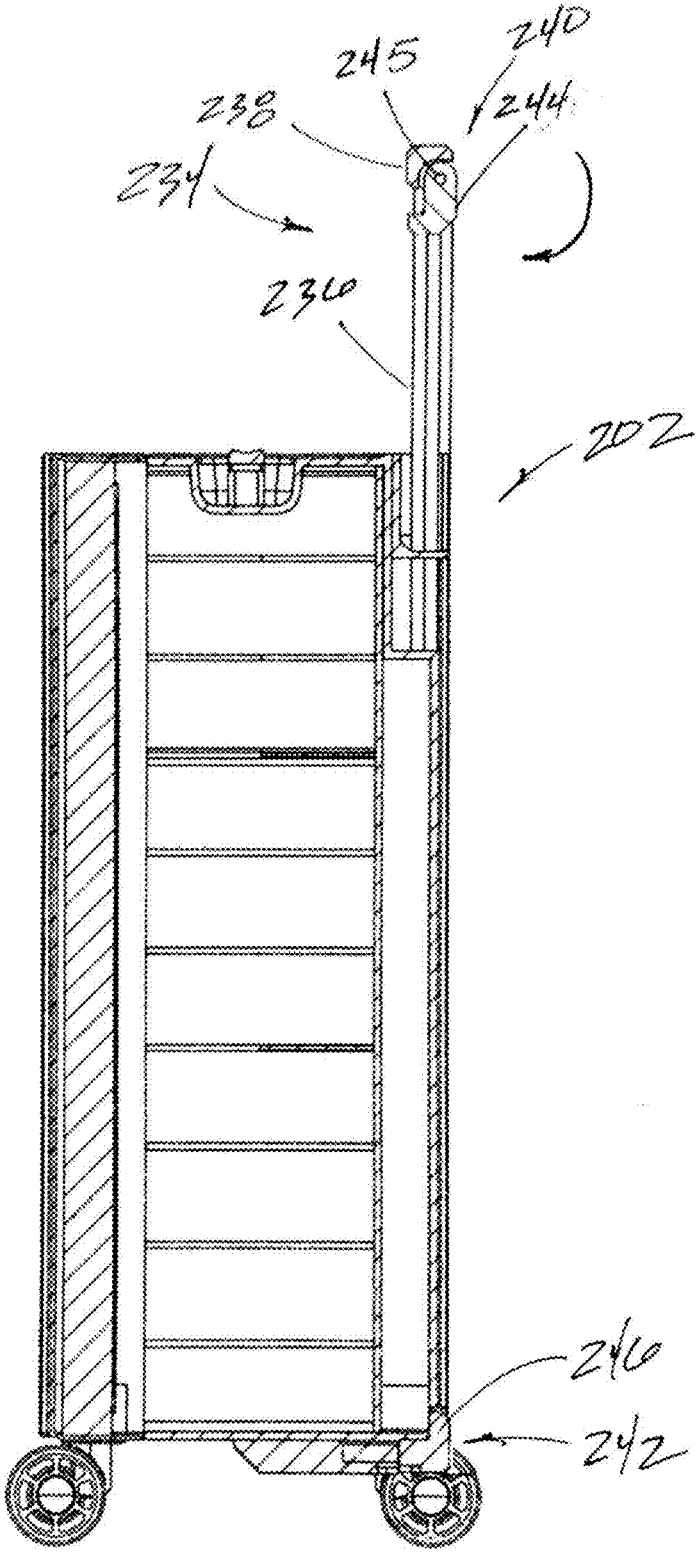
Figure 8:
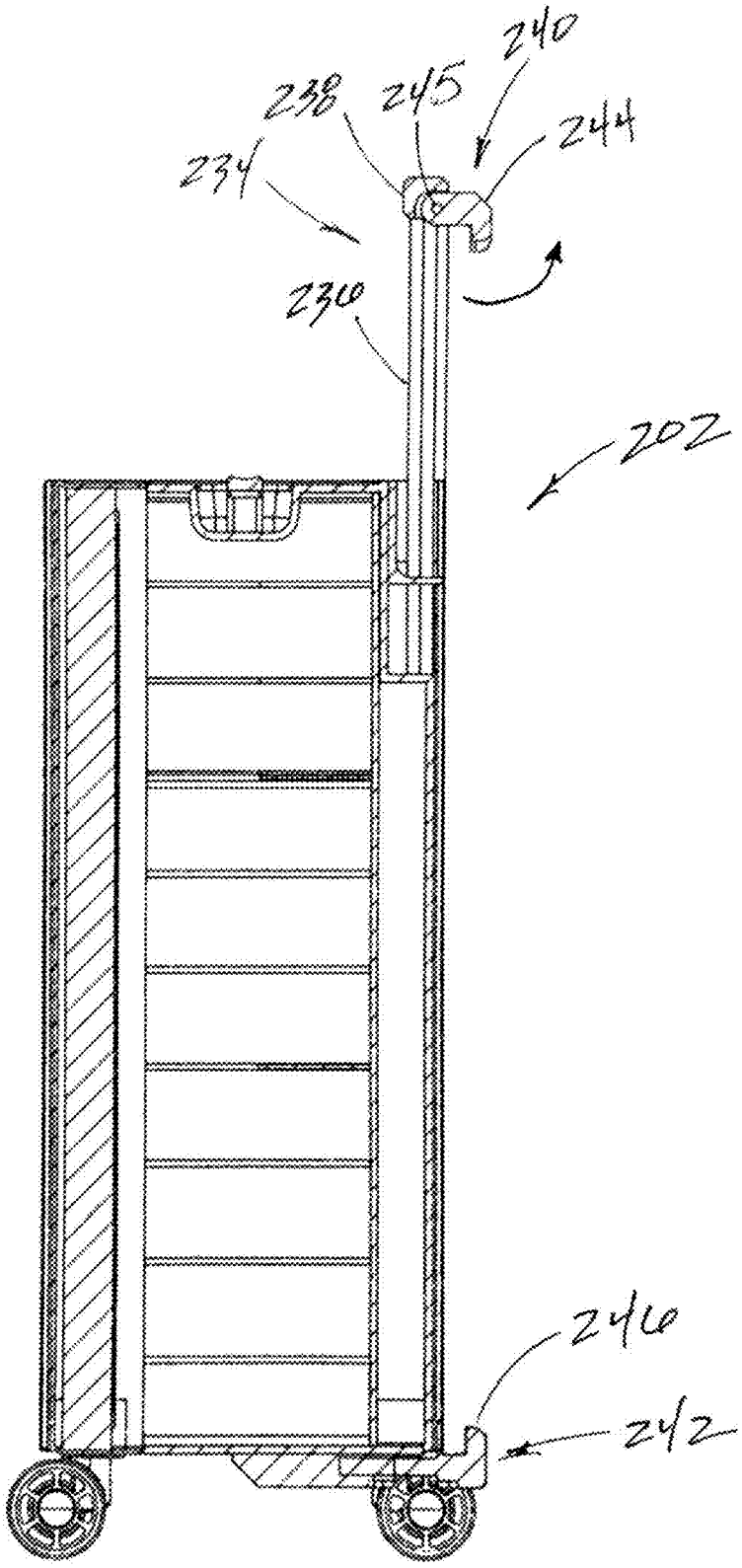

In some embodiments, as shown in FIGS. 7 and 8, the upper handle 238 may include an upper extendable attachment mechanism 240 and the roller case 202 may include a lower extendable attachment mechanism 242. For clarity, FIGS. 7 and 8 are side sectional views. The upper and lower extendable attachment mechanisms 240, 242 may be each be designed to engage with a particular first attachment mechanism 134 on the utility case 102. In this way, the utility case 102 may be coupled to the roller case 202 using the attachment mechanisms 240, 242, 134.

In some embodiments, the upper extendable attachment mechanism 240 includes a first hook member 244. In some embodiments, the first hook member 244 may be rotatable about a pivot point 245 (e.g., about a dowel or similar configured with the handle 238) such that it may be rotated downward (e.g., clockwise) into a retracted and closed position as shown in FIG. 7, and/or rotated upward (e.g., counterclockwise) into an extended and open position as shown in FIG. 8. The hook member 244 may be rotated manually by grasping the hook member 244 and may be held in its retracted position and/or in its extended position(s) using detents or other suitable holding mechanisms. The hook member 244 also may be spring-loaded such that it may be activated (e.g., by pushing on it, by pushing a button, etc.) to cause the hook member 244 to automatically rotate upward into its extended position and/or downward into its retracted position. It also is contemplated that the hook member 244 may be extended and/or retracted linearly in addition to and/or instead of rotatably, e.g., along a track in and out. As shown in FIG. 8, when the hook member 244 is extended, the hook member 244 may be facing downwards. In addition, it also may be preferable that the hook member 244, whether in its extended position and/or in its retracted position, not obstruct a user from gripping the handle 238. For example, when the hook member 244 is retracted or extended, it may be preferable that an adequate amount of free space is made available between the handle 238 and the hook member 244 (e.g., at least one inch) such that the user may still grip the handle 238 with his/her fingers.

In some embodiments, as shown in FIGS. 7 and 8, the lower extendable attachment mechanism 242 includes a second hook member 246. In some embodiments, the second hook member 246 may slide inward (e.g., linearly) into a retracted and closed position as shown in FIG. 7, and/or outward (e.g., linearly) into an extended and open position as shown in FIG. 8. The hook member 246 may be extended manually by grasping the hook member 246 and held in its retracted position and/or in its extended position(s) using detents or other suitable holding mechanisms. The hook member 246 also may be spring-loaded such that it may be activated (e.g., by pushing on it, by pushing a button, etc.) to cause the hook member 246 to automatically extend outward into its extended position and/or inward into its retracted position. It also is contemplated that the hook member 246 may be extended and/or retracted rotatably in addition to and/or instead of slidably, e.g., about a pivot point.

In some embodiments, as shown in FIG. 2, the one or more first attachment mechanisms 134 configured with the utility case 102 may include one or more slots 136. The one or more slots 136 may be configured on the left side 104 of the case 102 and on the right side 106 of the case 102 (blocked from view in FIG. 2). In some embodiments, the lid 116 may include a slot 136 on the left and right sides 104, 106 and the case's body portion 118 may include a slot 136 on the left and right sides 104, 106. While blocked from view, the slots 136 configured on the right side 106 of the case 102 may generally match the slots 136 on the left side 104 of the case 102 in shape, form, and location on the respective side.

Figure 9:
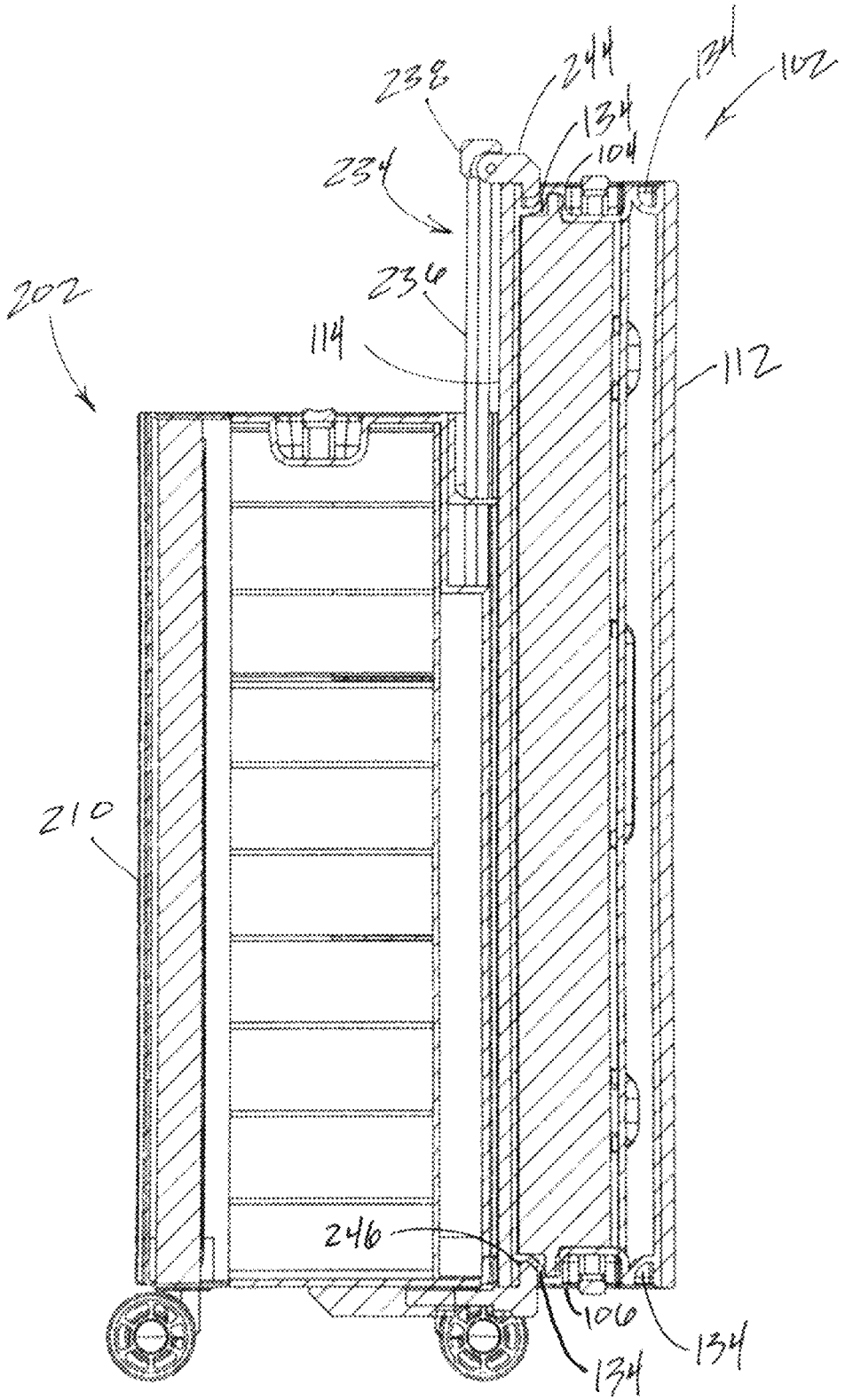
FIG. 9 shows aspects of a utility case removably coupled to a roller case according to exemplary embodiments hereof.

FIG. 9 shows the utility case 102 removably coupled to the roller case 202 by engaging the roller case's upper and lower hooks 244, 266 (both preferably extended) with the utility case's left side slot 136 and right side slot 136, respectively. That is, the utility case's left side slot 136 may receive the roller bag's upper extended hook member 244 and the utility case's right side slot 136 may receive the roller bag's lower extended hook member 246. As shown, with the left and right slots 136 engaged with the upper and lower hook members 244, 246, respectively, the utility case 102 may be locked to the roller case 202.

In some embodiments, the utility case's right side slot 136 (or alternatively its left side slot 136) may be placed onto the roller case's extended lower hook member 246 and the roller case's extendable handle system 234 may be extended to a position that places its upper hook member 244 slightly above the utility case's left side slot 136 (or alternatively its right side slot 136). The utility case 102 may then be properly positioned to place the upper slot 136 directly below the roller case's upper hook member 244 such that the extendable handle system 234 may be lowered thereby engaging the roller case's upper hook member 244 into the utility case's upper slot 136. In this arrangement, the roller case's extendable handle system 234 may be releasably locked in place (e.g., using detents, push rods, etc.) so that the utility case 102 coupled thereto may be held securely in place. Then, when a user wishes to release the utility case 102 from the roller case 202, the roller case's extendable handle system 234 may be unlocked and extended upward to release the utility case 102 therefrom. In some embodiments, the extendable handle 234 may be biased (e.g., spring-loaded) downward to facilitate the engagement of the upper hook member 244 and the utility case's upper slot 136 and releasably lockable in the engagement position.

In some embodiments, because the utility case 102 may include two slots 134 on each of the left and right sides 104, 106, e.g., one configured in the side of the lid 116 and one configured in the side of the body portion 118, the utility case 102 may be coupled to the roller case 202 with either its top side 112 (as shown in FIG. 9) or with its bottom side 114 facing outward and away from the roller case 202 (depending on whether the left and right lid side slots 134 or the left and right body portion side slots 134 are engaged with the rolling case's upper and hook members 244, 246).

Figure 10:
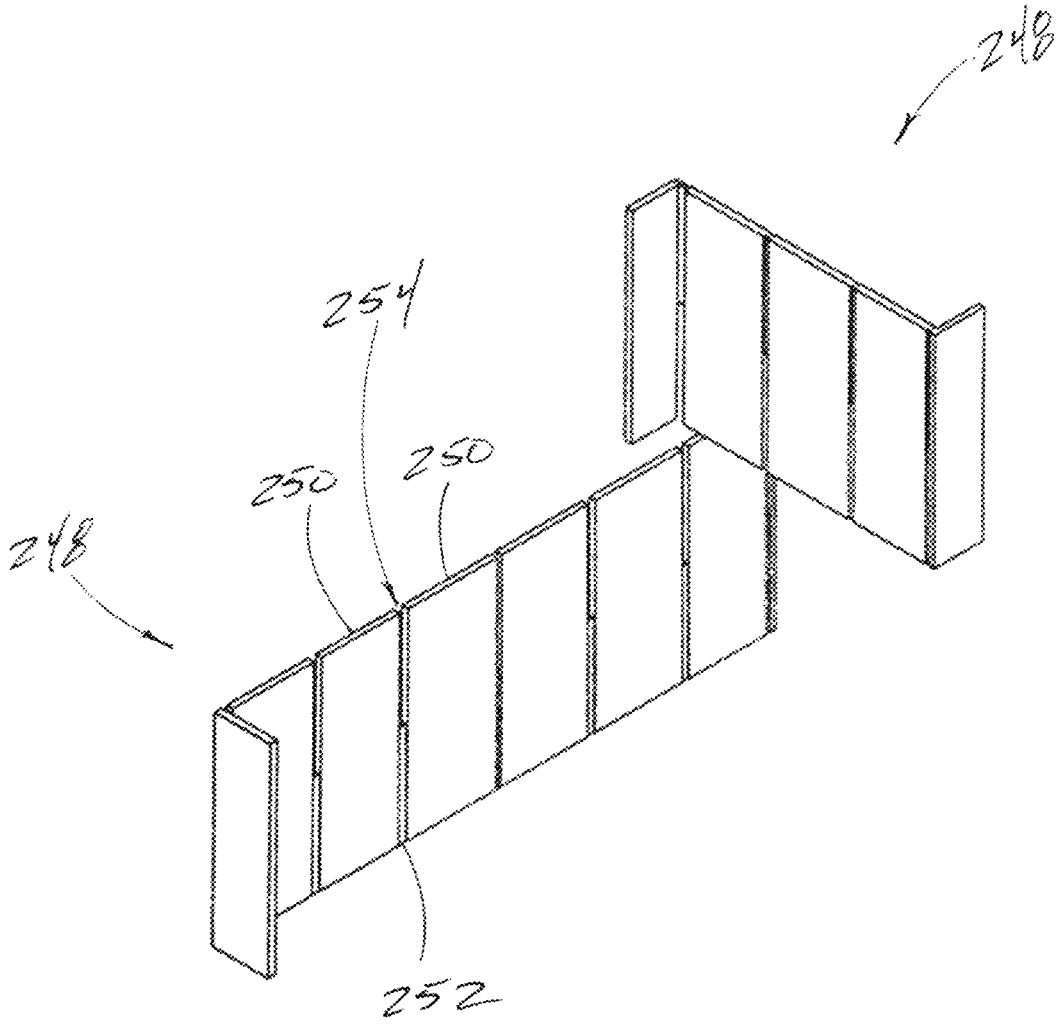
FIG. 10 shows aspects of a partition according to exemplary embodiments hereof.

In some embodiments, as shown in FIG. 10 (also see FIG. 5), the system 10 may include one or more adjustable partitions 248 or dividers that may be implemented within the roller case's inner volume 222 to divide the space therein into different sections. In some embodiments, each partition 248 may include two or more sections 250 coupled side-by-side with one another using a flexible joint 252. In some embodiments, each flexible joint 252 may extend from a first edge (e.g., a bottom edge) of the joined sections 250 to an intermediate location between the first edge and a second edge (e.g., the top edge) of the sections 250 (and preferably about midway between the bottom and top edges) thereby leaving a gap 254 extending from the intermediate location to the top edges of the sections 250. As such, in some embodiments, two partitions 248, with the first partition upside down compared to the second partition 248, may be joined together by inserting a lower gap 254 of the first partition 248 into an upper gap 254 of the second partition 248 and then sliding the first and second partitions 248 together until the gap 254 of the first partition 248 overlays the flexible joint 252 of the second partition 248 and the gap 254 of the second partition 248 overlays the flexible joint 252 of the first partition 248. In this arrangement, the first and second partitions 248 may be generally perpendicular to one another, however, it is understood that the partitions 248 also may be flexed and/or angled laterally such that the partitions 248 may be set at other angles with respect to one another.

In some embodiments, the sections 250 of the partitions 248 may be magnetized and/or ferromagnetic. In addition, each partition 248 may include a magnetized and/or ferromagnetic end section 256 (preferably on both far ends) that may be engaged with a corresponding magnetized and/or ferromagnetic section 250 of a joined partition 248 to generally hold the joined partitions 248 together and in place.

In addition, in some embodiments, as shown in FIG. 5, the sidewalls 256 of the roller case's inner volume 222 may include one or more vertical slots 258 designed to receive a far end edge of a given partition 248. In this way, a partition 248 may be inserted into the roller case's inner volume 222 and held in place by the engagement of the partition's far edge within the sidewall slot 258. It also is contemplated that the roller case's inner sidewalls 256 comprise magnetic and/or ferromagnetic materials such that the magnetized and/or ferromagnetic sections of a partition 248 (e.g., a far end section 250 and/or an interior section 250) also may be used to secure a given partition 248 to the case's inner sidewalls 256.

Also, as demonstrated in FIG. 5, because the partitions 248 comprise multiple sections 250 joined by flexible joints 250, the partitions 248 may be bent at any desired joint 250 to form a wide variety of partition shapes.

It is understood that similar such partitions 248 also may be implemented into the inner volume 122 of the utility case 102.

In some embodiments, the shell of the roller case 202 comprises rubber coated plastic and/or other suitable materials.

Docking Assembly 300

Figure 11:
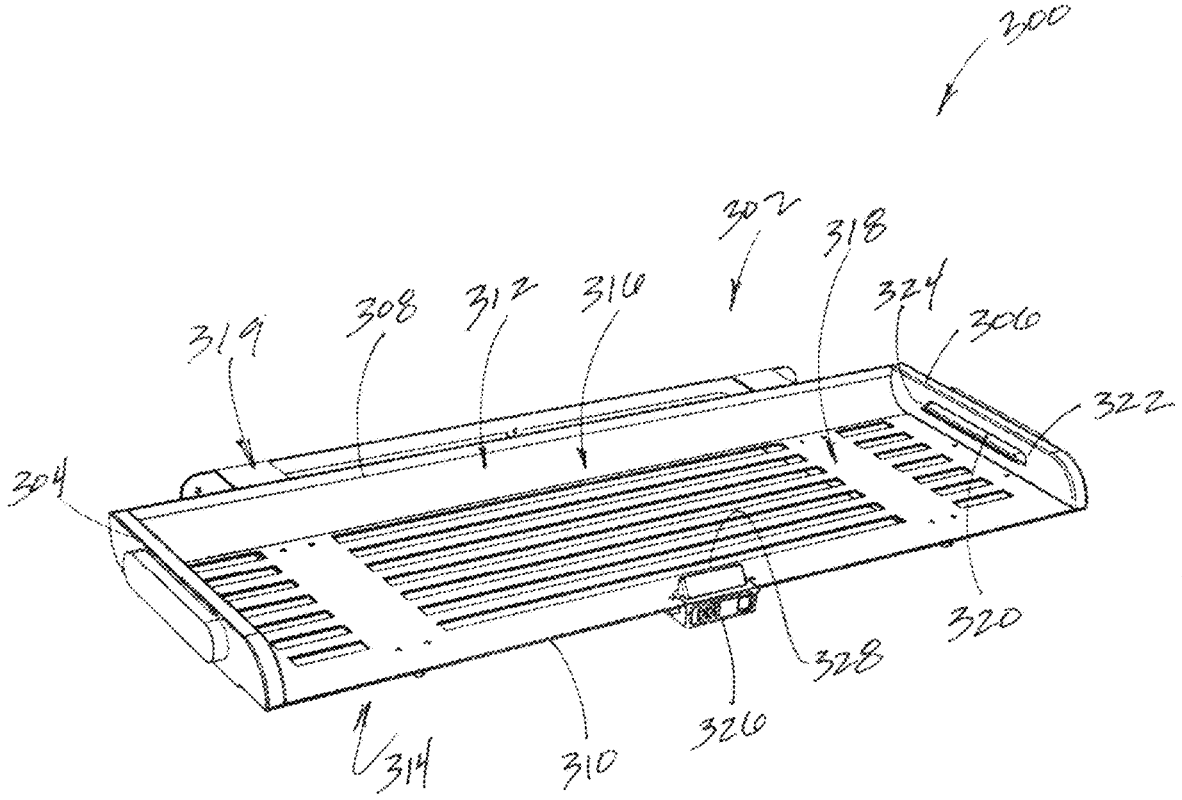
FIGS. 11-12 show aspects of a docking assembly according to exemplary embodiments hereof.
Figure 12:
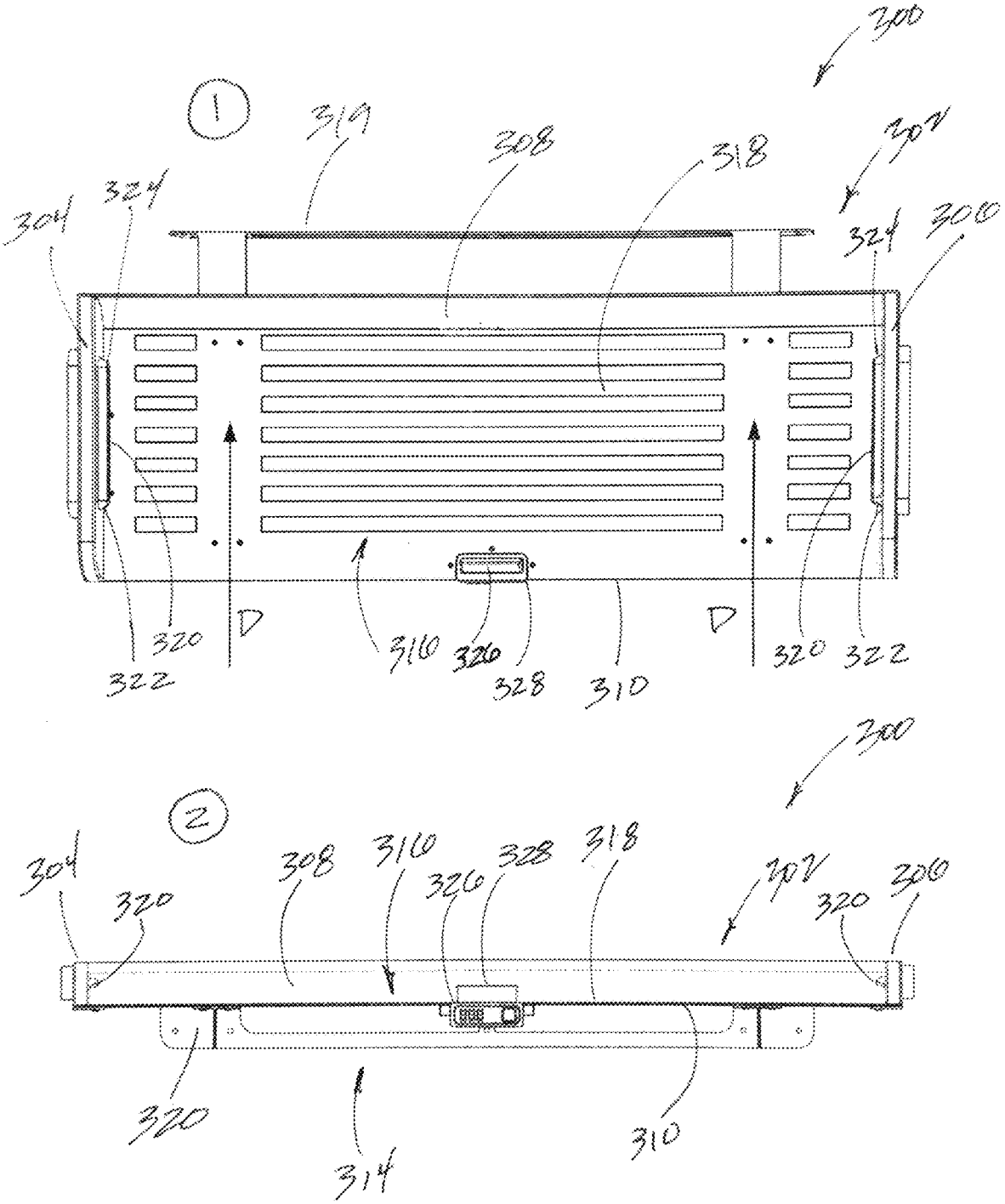

FIG. 11 shows a perspective view of the docking assembly 300, FIG. 12, image (1) shows a top view of the assembly 300, and FIG. 12, image (2) shows a front view of the same.

In some embodiments, as shown in FIGS. 11 and 12, the docking assembly 300 includes a bracket 302 generally including a left side defined by a left side wall 304, a right side defined by a right side wall 306, a rear side defined by a rear side wall 308, a front side 310, a generally open top side 312, and a bottom side 314. The bracket 302 may include an inner portion 316 generally defined by the left side wall 304, the right side wall 306, the rear side wall 308, the front side 310, and a lower or bottom surface 318. In some embodiments, the inner portion 316 of the bracket 302 is designed to receive and support a lower portion of the utility case 102, e.g., with the bottom side 114 of the utility case 102 resting on the bracket's lower surface 318 and with the left and right sides 104, 106 of the utility case 102 engaged with the bracket's left and right side walls 304, 306, respectively.

The docking assembly 300 also may include a wall mount 319 coupled to the bracket 302 (e.g., to the bracket's rear side wall 308) to mount the docking assembly 300 to a wall or other type of support structure.

In some embodiments, the docking assembly 300 includes a left side holding member 320 configured with and extending from the left side wall 304 into the inner portion 316, and a right side holding member 320 configured with and extending from the right side wall 306 into the inner portion 316. The left and right holding members 320 may include elongated tabs, posts, buttons, and/or other suitable types of holding members. The left and right holding members 320 may each be depressible inward (e.g., toward each respective left and/or right side wall 304, 306 and away from the inner portion 316). The left and right holding members 320 also may be spring-loaded or otherwise biased in the outward direction away from each respective left and/or right side wall 304, 306 and toward the inner portion 316. In this way, when the left or right side holding member 320 is pressed inward, it may automatically return to its extended position upon release.

In some embodiments, the left side holding member 320 is designed to engage with the utility case's left side first attachment mechanism(s) 134 and the right side holding member 320 is designed to engage with the utility case's right side attachment mechanism(s) 134 when the utility case 102 is received into the docking assembly's inner portion 316.

In some embodiments, the utility case's left and right side first attachment mechanisms 134 include left and right side slots 136 (see FIG. 2), and the docking assembly's left and right side holding members 320 are designed to be received into the left and right side slots 136, respectively, when utility case 102 is received into the docking assembly's inner portion 316.

In some embodiments, the left and right side holding members 320 may be depressed to accommodate loading the utility case 102 into the docking assembly's inner portion 316, and then subsequently released to extend into each respective slot 136. In some embodiments, the holding members 320 each include a front end 322 facing the assembly's front side 310, and a rear end 324 facing the assembly's rear wall 308. In some embodiments, the front ends 322 and/or the rear ends 324 of the left and right holding members 320 are each tapered inward thereby each forming a wedge-shaped receiving edge.

In some embodiments, when the utility case 102 is inserted into the docking assembly's inner portion 316 from the front 310 of the assembly 300 in the direction of the arrows D (FIG. 12, image (1)), the utility case's left and right sides 104, 106 may initially engage the front ends 322 of the left and right holding members 320, respectively. As the utility case 102 is moved further into the assembly's inner portion 316, the case's left and right sides 104, 106 may ride along the wedge-shaped front ends 322 of the left and right holding members 320, respectively, thereby causing the left and right holding members 320 to each depress. This may continue until the utility case 102 is fully inserted into the assembly's inner portion 316 at which time the left and right holding members 320 may be aligned with the case's left and right slots 136, respectively, such that the holding members 320 may be released from their depressed states and may each be received into a respective slot 136. This may lock the utility case 102 within the inner portion 316 of the docking assembly 300.

In some embodiments, to remove the utility case 102 from the above-described locked position, the case 102 may be pulled forward in a generally opposite direction to the arrows D. When this happens, the rear sidewalls within each slot 136 may engage and ride along the holding members' wedge-shaped rear ends 324 thereby causing the left and right holding members 320 to each depress and allow the case 102 to be removed out the front 310 of the assembly's inner portion 316.

In some embodiments, it may be preferable that the shape and form of the left and right holding members 320 and of the left and right slots 136 be such that once the left and right holding members 320 are received into respective left and right slots 136 on the utility case 102, that the utility case 102 may only be removed from the docking assembly 300 by moving the utility case 102 forward and towards the front 310 of the docking assembly 300 (e.g., in the direction opposite the arrows D in FIG. 12. That is, it may be preferable that the case 102 may not be removed from the docking assembly 300 by lifting the case 102 upward in a direction generally away from, e.g., perpendicular to, the docking assembly's lower surface 318. This may be accomplished by providing sufficiently sharp edges on the slots 136 and on the portions of the holding members 320 between the front and rear ends 322, 324. In some embodiments, however, it is contemplated that the utility case 102 may be inserted into the docking assembly's inner portion 316 from above, wherein the bottom edges of the case 102 on the left and right sides 104, 106 may engage with and cause the docking assembly's holding members 320 to depress. However, it is preferable that the utility case 102 may not be removed from the inner portion 316 by reversing this motion.

Figure 13:
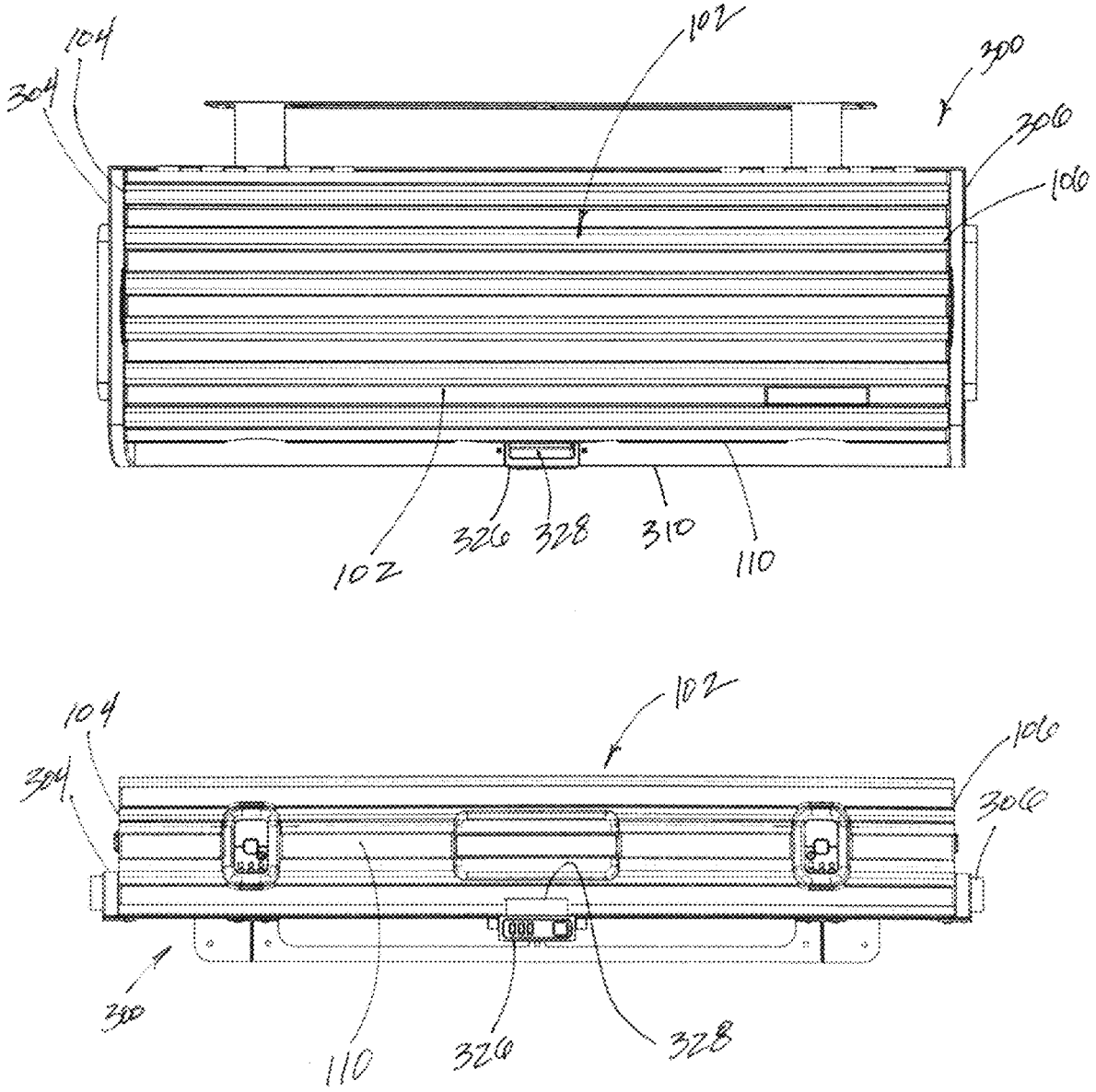
FIG. 13 shows aspects of a utility case configured with a docking assembly according to exemplary embodiments hereof.
Figure 14:
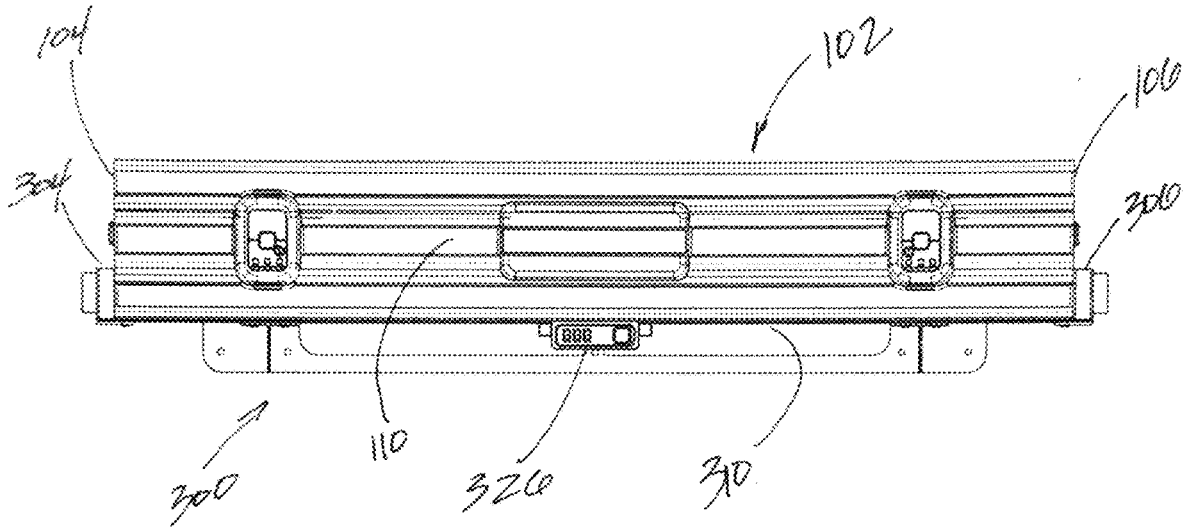
FIG. 14 shows aspects of a utility case configured with a docking assembly and of a docking assembly alone according to exemplary embodiments hereof.
Figure 14:
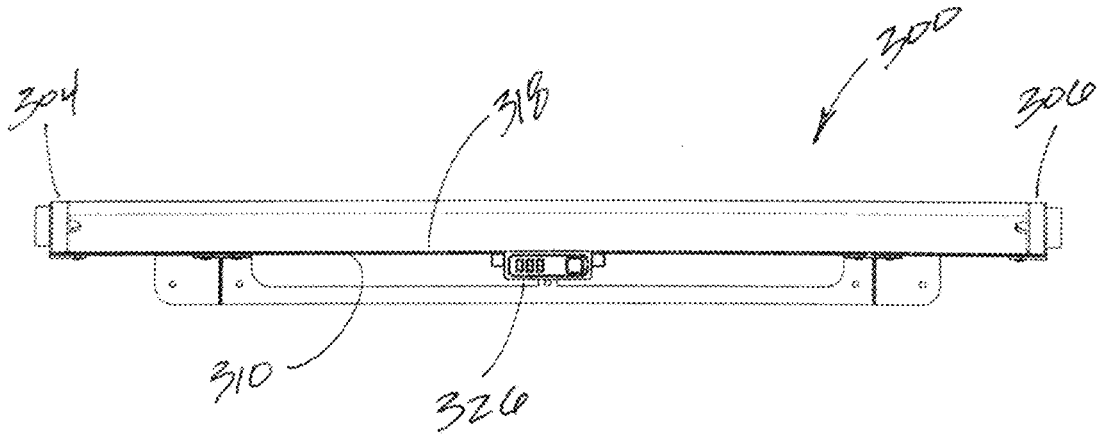

In some embodiments, as shown in FIGS. 11-14, the docking assembly 300 includes a locking assembly 326 configured to lock and/or unlock a utility case 102 within the assembly's inner portion 316. FIGS. 11, 12 and 13 show the locking assembly 326 in a locked configuration with FIG. 13 showing the utility case 102 held within the assembly's inner portion 316, and FIG. 14 shows the locking assembly 326 unlocked and with the utility case 102 held within the assembly's inner portion 316.

In some embodiments, as shown in FIGS. 11-14, the locking assembly 326 includes a locking tab 328 extendable upwards and/or downwards at or near the assembly's front side 310 (preferably about midway between the left and right sidewalls 304, 306). As shown in FIG. 13, when the locking tab 328 is extended upward, the locking tab 328 may obstruct movement of a utility case 102 in a direction generally opposite the arrows D in FIG. 12. As such, with its movement obstructed, the case 102 may not be removable from the docking assembly's inner portion 316. However, when the locking tab 328 is retracted (e.g., lowered), as shown in FIG. 14, the locking tab 328 may no longer be obstructive and the utility case 102 may be removed from the assembly 300 (by moving the case 102 in a direction generally opposite the arrows D in FIG. 12).

In some embodiments, the locking assembly 326 includes an activation mechanism that may be implemented to cause the extension and/or retraction (i.e., the locking and unlocking) of the locking tab 328. For example, the activation mechanism may include a combination lock, a key lock, a retina scanner, a fingerprint scanner, a voice recognition system, other types of activation mechanisms, and/or any combinations thereof. When the locking tab 328 is locked, it may not be depressible and may be held fixedly in the extended upright position, and when the locking tab 328 is unlocked, it may be depressible such that a user may press the locking tab 328 downward. In other embodiments, when activated into the locked position, the locking tab 328 may automatically extend, and when activated into the unlocked position, the locking tab 328 may automatically retract.

In some embodiments, the docking assembly 300 comprises powder coated stainless steel (e.g., 12 GA powder coated 316 stainless steel) and/or other suitable materials.

It is understood that any details and/or aspects of any embodiments of the carrying case system 10 described herein may be combined with any details and/or aspects of any other embodiments of the carrying case system 10 in any way to form additional embodiment(s) of the carrying case system 10 all of which are within the scope of the carrying case system 10.

Where a process is described herein, those of ordinary skill in the art will appreciate that the process may operate without any user intervention. In another embodiment, the process includes some human intervention (e.g., a step is performed by or with the assistance of a human).

As used herein, including in the claims, the phrase "at least some" means "one or more," and includes the case of only one. Thus, e.g., the phrase "at least some ABCs" means "one or more ABCs" and includes the case of only one ABC.

As used herein, including in the claims, term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

As used herein, including in the claims, the phrase "based on" means "based in part on" or "based, at least in part, on," and is not exclusive. Thus, e.g., the phrase "based on factor X" means "based in part on factor X" or "based, at least in part, on factor X." Unless specifically stated by use of the word "only", the phrase "based on X" does not mean "based only on X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and so on, in the description and claims, are used to distinguish or identify, and not to show a serial or numerical limitation. Similarly, letter labels (e.g., "(A)", "(B)", "(C)", and so on, or "(a)", "(b)", and so on) and/or numbers (e.g., "(i)", "(ii)", and so on) are used to assist in readability and to help distinguish and/or identify, and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

As used herein, including in the claims, the terms "multiple" and "plurality" mean "two or more," and include the case of "two." Thus, e.g., the phrase "multiple ABCs," means "two or more ABCs," and includes "two ABCs." Similarly, e.g., the phrase "multiple PQRs," means "two or more PQRs," and includes "two PQRs."

The present invention also covers the exact terms, features, values and ranges, etc. in case these terms, features, values and ranges etc. are used in conjunction with terms such as about, around, generally, substantially, essentially, at least etc. (i.e., "about 3" or "approximately 3" shall also cover exactly 3 or "substantially constant" shall also cover exactly constant).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components unless specifically so stated.

It will be appreciated that variations to the embodiments of the invention can be made while still falling within the scope of the invention. Alternative features serving the same, equivalent or similar purpose can replace features disclosed in the specification, unless stated otherwise. Thus, unless stated otherwise, each feature disclosed represents one example of a generic series of equivalent or similar features.

The present invention also covers the exact terms, features, values and ranges, etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

Use of exemplary language, such as "for instance", "such as", "for example" ("e.g.,") and the like, is merely intended to better illustrate the invention and does not indicate a limitation on the scope of the invention unless specifically so claimed.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

The invention claimed is:

1. A carrying case system comprising:

a first carrying case including a first side and a second side opposite the first side, and a first case first attachment mechanism configured with the first side and a first case second attachment mechanism configured with the second side; and a docking assembly including a first side wall and a second side wall opposing the first side wall with the first and second side walls spaced apart to receive the first carrying case within an inner portion of the docking assembly, the first side wall configured with a first inner side attachment mechanism and the second side wall configured with a second inner side attachment mechanism;

wherein the first case first attachment mechanism is engageable with the first inner side attachment mechanism, and the first case second attachment mechanism is engageable with the second inner side attachment mechanism to releasably couple the first case to the docking assembly, wherein the first and second inner side attachment mechanisms are elongated tabs that extend into the inner portion and slidingly receive slots forming the first case first and second attachment mechanisms such that the first case is slidable into the docking assembly from a front side of the docking assembly toward a wall mount of the docking assembly coupled to the first and second sidewalls at a back side of the docking assembly.

2. The carrying case system of claim 1 wherein the elongated tabs are depressible locking tabs.

3. The carrying case system of claim 1 wherein when the elongated tabs are received into the slots, the elongated tabs disallow the first case from being removed from the docking assembly in a direction that is not parallel to the elongated tabs.

4. The carrying case system of claim 1 further comprising a locking tab configured on the front side of the docking assembly and adapted to obstruct movement of the first case towards the front side of the docking assembly when the elongated tabs are received into the slots.

5. The carrying case system of claim 4 wherein the locking tab includes an activation mechanism configured to lock the locking tab in an extended position or to unlock the locking tab from the extended position.

6. The carrying case system of claim 5 wherein when the locking tab is locked in the extended position, the carrying case is not removable from the docking assembly, and when the locking tab is unlocked from the extended position, the carrying case is removable from the docking assembly.

7. The carrying case system of claim 1 wherein the first carrying case is a gun case.

8. The carrying case system of claim 1 wherein the first carrying case is a rifle case.

9. A carrying case system comprising:

a gun case including a first side and a second side opposite the first side with a first slot along the first side and a second slot along the second side; and a docking assembly including a wall mount from which a bracket extends that has a first side wall and a second side wall opposing the first side wall to receive the gun case, the first side wall having a first elongated tab and the second side wall having a second elongated tab, wherein the first elongated tab is engageable with the first slot and the second elongated tab is engageable with the second slot such that the gun case is slidable into the docking assembly from a front side of the docking assembly toward the wall mount of the docking assembly coupled to the bracket at a back side of the docking assembly.

10. The carrying case system of claim 9 wherein the first and second elongated tabs are depressible locking tabs.

11. The carrying case system of claim 9 wherein when the first and second elongated tabs are received into the first and second slots, the first and second elongated tabs disallow the gun case from being removed from the docking assembly in a direction that is not parallel to the first and second elongated tabs.

12. The carrying case system of claim 9 further comprising a locking tab configured on the front side of the docking assembly and adapted to selectively obstruct movement of the gun case towards the front side of the docking assembly when the first and second elongated tabs are received into the first and second slots.

13. The carrying case system of claim 12 wherein the locking tab includes an activation mechanism configured to lock the locking tab in an extended position or to unlock the locking tab from the extended position.

14. The carrying case system of claim 13 wherein when the locking tab is locked in the extended position, the gun case is not removable from the docking assembly, and when the locking tab is unlocked from the extended position, the gun case is removable from the docking assembly.

15. The carrying case system of claim 9 wherein the gun case is a rifle case.

* * * * *